US007086997B1

(12) United States Patent
Fields et al.

(10) Patent No.: US 7,086,997 B1
(45) Date of Patent: Aug. 8, 2006

(54) MARTIAL ARTS PRACTICE DEVICE

(75) Inventors: Sarah B. Fields, Midwest City, OK (US); Greg A. Davis, Midwest City, OK (US)

(73) Assignee: Century Incorporated, Midwest City, OK (US)

( * ) Notice: Subject to any disclaimer, the term of this patent is extended or adjusted under 35 U.S.C. 154(b) by 210 days.

(21) Appl. No.: 10/755,436

(22) Filed: Jan. 12, 2004

(51) Int. Cl.
*A63B 69/00* (2006.01)

(52) U.S. Cl. ..... 482/90; 482/83; 482/86; 482/87

(58) Field of Classification Search ..... 482/83, 482/86, 87, 905, 52; 473/418–420, 422; 273/406, 392, 108, 440.1, 348, 393; D21/302, D21/715–6, 787, 798
See application file for complete search history.

(56) References Cited

U.S. PATENT DOCUMENTS

| | | | | | |
|---|---|---|---|---|---|
| 4,077,624 | A | | 3/1978 | Feaser | |
| 4,662,630 | A | * | 5/1987 | Dignard et al. | 482/83 |
| 4,913,419 | A | | 4/1990 | McAuliffe | |
| 5,090,690 | A | * | 2/1992 | Huang | 482/52 |
| 5,183,451 | A | | 2/1993 | Hautamaki | |
| D334,784 | S | * | 4/1993 | DeZulueta | D21/798 |
| 5,277,679 | A | | 1/1994 | Wells | |
| 5,352,170 | A | | 10/1994 | Condo et al. | |
| 5,389,057 | A | | 2/1995 | Zagata, Jr. | |
| D356,127 | S | | 3/1995 | Mara | |
| 5,458,552 | A | * | 10/1995 | Mara | 482/90 |
| 5,472,395 | A | | 12/1995 | Trocchio | |
| D373,607 | S | * | 9/1996 | Proudfoot | D21/798 |
| 5,624,358 | A | * | 4/1997 | Hestilow | 482/90 |
| 5,722,920 | A | | 3/1998 | Bauer | |
| 5,839,991 | A | * | 11/1998 | Hall | 482/23 |
| 5,897,465 | A | * | 4/1999 | Hautamaki | 482/83 |
| 6,027,435 | A | * | 2/2000 | Nadorf et al. | 482/146 |
| 6,033,348 | A | | 3/2000 | Warshauer | |
| 6,183,399 | B1 | * | 2/2001 | Chen | 482/90 |
| 6,348,028 | B1 | * | 2/2002 | Cragg | 482/148 |
| 6,432,027 | B1 | | 8/2002 | Haselrig | |
| 6,790,167 | B1 | * | 9/2004 | Carlin et al. | 482/90 |

OTHER PUBLICATIONS

Internet Web page published at www.focusmaster.com titled "Focusmaster—Products—G-1000 Single Station," (no date available but admitted to be prior art) 1 p.

(Continued)

*Primary Examiner*—Jerome Donnelly
*Assistant Examiner*—Allana Lewin
(74) *Attorney, Agent, or Firm*—McAfee & Taft

(57) ABSTRACT

A martial arts practice device that is freestanding and can be used by one or more practitioners. The device has a base which can be filled with liquid for weighting, a stem extending upwardly from the base and a plurality of rails attached to the stem. A plurality of target adapter assemblies are slidably mounted on the rails. A target is attached to each target adapter assembly by a target attachment assembly. The target attachment assemblies include an elastomeric pivot so that the targets can pivot in any direction with respect to the target adapter assemblies.

44 Claims, 7 Drawing Sheets

OTHER PUBLICATIONS

Internet Web page published at www.focusmaster.com titled "Focusmaster—Products—G-4000," (no date available but admitted to be prior art) 1 p.

Internet Web page published at www.focusmaster.com titled "Focusmaster—Accessories," (no date available but admitted to be prior art) 1 p.

* cited by examiner

MARTIAL ARTS PRACTICE DEVICE

BACKGROUND OF THE INVENTION

1. Field of the Invention

This invention relates to devices for use in practicing martial arts activities, and more particularly, to a freestanding marital arts practice device with a plurality of angularly adjustable and infinitely vertically adjustable and interchangeable targets. The device is adapted for multiple users.

2. Description of the Prior Art

Martial arts, like all athletic activities, require practice to perfect skills. To facilitate this, a number of practice devices have been developed. These provide one or more targets which can be struck or kicked by martial arts students and practitioners in order to practice accuracy and strength.

U.S. Pat. No. 6,033,348 to Warshauer discloses a martial arts practice device having a joint member positioned in a receiving portion of a housing member. A striking member is attached to the joint member by first and second joining members. The joint member is fixed in one of a plurality of vertically spaced positions by use of pins extending through holes in the housing member and joint member. A problem with this apparatus is that the number of vertical positions is limited to the specific locations defined by the holes. The present invention solves this problem by providing infinite vertical adjustment.

Another problem with Warshauer is that the apparatus must be attached to a separate support. The present invention is a self-contained and freestanding unit that requires no specific location or external support.

One self-contained target apparatus is disclosed in U.S. Pat. No. 5,458,552 to Mara which provides for variable positioning of a plurality of targets on a post. However, this device does not provide for infinitely adjustable vertical positioning as does the present invention, and Mara also does not allow for the quick positional changes of the present invention. The Mara apparatus also appears to require attachment of its base to a floor surface so that it will not fall down when struck. The present invention solves this latter problem by providing a freestanding unit with a weighted base.

U.S. Pat. No. 4,662,630 to Dignard et al. discloses a martial arts striking apparatus which provides infinite vertical adjustment and rotational adjustment of a target on a track. However, this apparatus has the problem of the target mounting not providing resilient deflection in all directions. The present invention solves this problem by a pivot assembly which will deflect when the target is struck from any direction. Dignard requires a pin to be disposed through holes to lock the target in a particular angular orientation. The present invention solves this problem by using a detent mechanism for quick changing of the target position. The Dignard patent also does not disclose a free-standing apparatus.

SUMMARY OF THE INVENTION

The martial arts practice device of the present invention is a freestanding unit designed for use by one or more martial arts practitioners at a time.

The freestanding martial arts practice device comprises a hollow base adapted for receiving a weighting fluid therein, a stem connected to the base and extending upwardly therefrom, a plurality of substantially vertical rails attached to the stem wherein each rail defines a channel therein, a target adapter assembly adapted for connection to a rail such that the target adapter assembly provides substantially infinite adjustment along a length of the rail, and a target connected to the target adapter assembly and moveable therewith.

Preferably, the stem defines a plurality of longitudinally extending grooves thereon. Each groove is adapted for receiving a rail therein. The stem also has a handhold defined thereon.

The target may be rotated with respect to the target adapter assembly between a plurality of operating positions thereon. Thus, angular adjustment of the targets is provided. The target is preferably connected to the target adapter assembly by a detent mechanism. The target is one of a plurality of interchangeable targets.

The device further comprises a target attachment assembly interconnecting the target and target adapter assembly. The target attachment assembly comprises an elastomeric pivot for providing resilient deflection of the target with respect to the target adapter assembly when the target is struck by a martial arts practitioner. The target is disposed at an acute angle with respect to the target adapter assembly, and the target adapter assembly may be selectively positioned between downwardly and upwardly angled positions of the target.

The target adapter assembly comprises a plate slidably disposed in a channel in the rail wherein the plate has a rod extending therefrom, a slider disposed adjacent to the rail and having a hole therein adapted for receiving the rod therethrough, and a fastener engaging the rod whereby the slider and plate can be locked against the rail at any location therealong. In the preferred embodiment, the rod is threaded, and the fastener is a wing knob. The slider has a neck extending therefrom, and a target attachment assembly interconnects the neck and target.

The target attachment assembly comprises a fitting adapted for positioning over the neck, a bracket adapted for attachment to the target, and a pivot assembly connected between the fitting and bracket such that the target may be pivoted with respect to the target adapter assembly. The pivot assembly allows the target to be pivoted in substantially all directions, and preferably comprises an elastomeric bushing. In the preferred embodiment, the pivot assembly further comprises a pair of pivot studs molded into opposite ends of the bushing. One of the pivot studs is adapted for connection to the fitting and the other of the pivot studs is adapted for connection to the bracket. Relative rotation between the pivot studs, fitting and bracket is prevented in the following manner. Each of the pivot studs has a square portion. The fitting has a square opening therein adapted for receiving the square portion of one of the pivot studs such that relative rotation between the pivot and fitting is prevented, and the bracket has a square opening therein adapted for receiving the square portion of the other of the pivot studs such that relative rotation between the pivot and bracket is prevented.

The fitting is rotatable with respect to the neck. The detent mechanism is used for selectively locking the fitting in any one of a plurality of positions with respect to the neck. The neck defines a hole therein, the fitting defines a plurality of holes therein selectively alignable with the hole in the neck, and the detent mechanism comprises a spring clip disposed in the neck. The spring clip has a lug thereon, and the lug is outwardly biased such that it will extend through the hole in the neck and any one of the holes in the fitting aligned therewith.

The target preferably comprises a target insert having proximate and distal ends, and a target foam adjacent to the target insert and also having proximate and distal ends. The proximate ends of the target insert and target foam are attached to the bracket. The target foam is preferably one of a pair of target foams disposed on opposite sides of the target insert. The bracket has a pair of fingers and the proximate ends of the target insert and target foam are disposed between the fingers.

The target may also further comprise a foam protective panel adjacent to the target foam and a foam protective cover disposed around the pivot assembly. A cover is provided which substantially encloses the target insert, target foam, foam protective panel, foam protective cover and at least a portion of the pivot assembly.

Numerous objects and advantages of the present invention will become apparent as the following detailed description of the preferred embodiment is read in conjunction with the drawings illustrating such embodiment.

BRIEF DESCRIPTION OF THE DRAWINGS

FIG. 6 shows an exploded view of a target assembly.

DESCRIPTION OF THE PREFERRED EMBODIMENT

Figure 1:
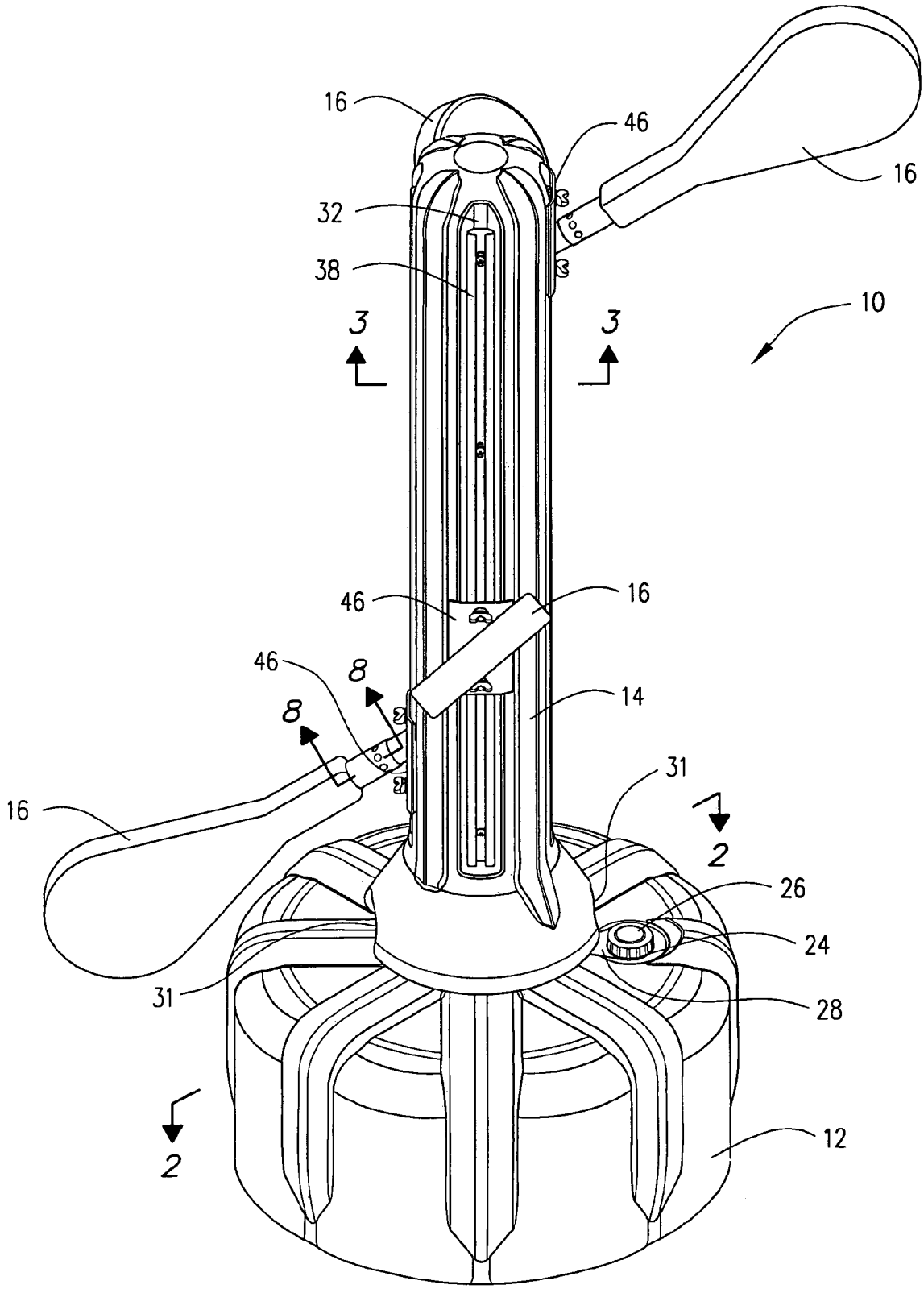
FIG. 1 is a perspective view of the martial arts practice device of the present invention.

Referring now to the drawings, and more particularly to FIG. 1, the martial arts practice device of the present invention is shown and generally designated by the numeral 10. Device 10 comprises a base 12, a stem 14 extending substantially vertically from the base and a plurality of target assemblies 16 attached to the stem.

Figure 2:
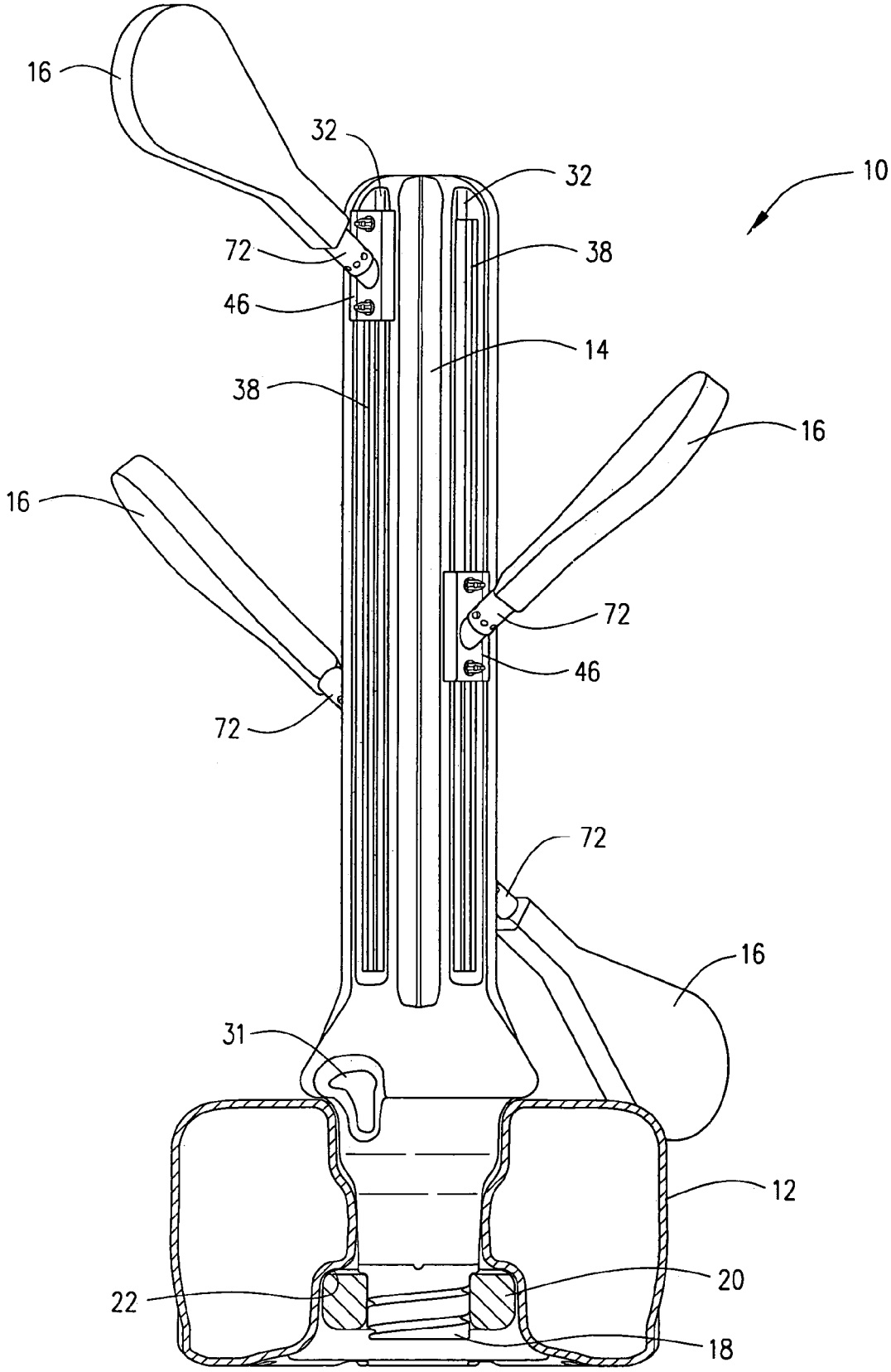
FIG. 2 is a partial elevation and a partial vertical cross section taken along lines 2—2 in FIG. 1.

Referring now also to FIG. 2, stem 14 has a threaded lower end 18 which engages a nut 20 disposed in a recess 22 in base 12. Base 12 is hollow and adapted for being filled with water through an opening 24 which is closeable by a cap 26. When filled with water, base 12 provides a heavily weighted support for device 10. A removable stem stop 28 prevents undesired rotation of stem 14 with respect to base 12. Threaded lower end 18 of stem 14, stem stop 28, base 12 and nut 20 are of a kind known in the art, such as found in the Century Wavemaster XXL™ freestanding punching bag. The other components of device 10 and the portion of stem 14 above lower end 18 are new parts of the present invention.

Figure 3:
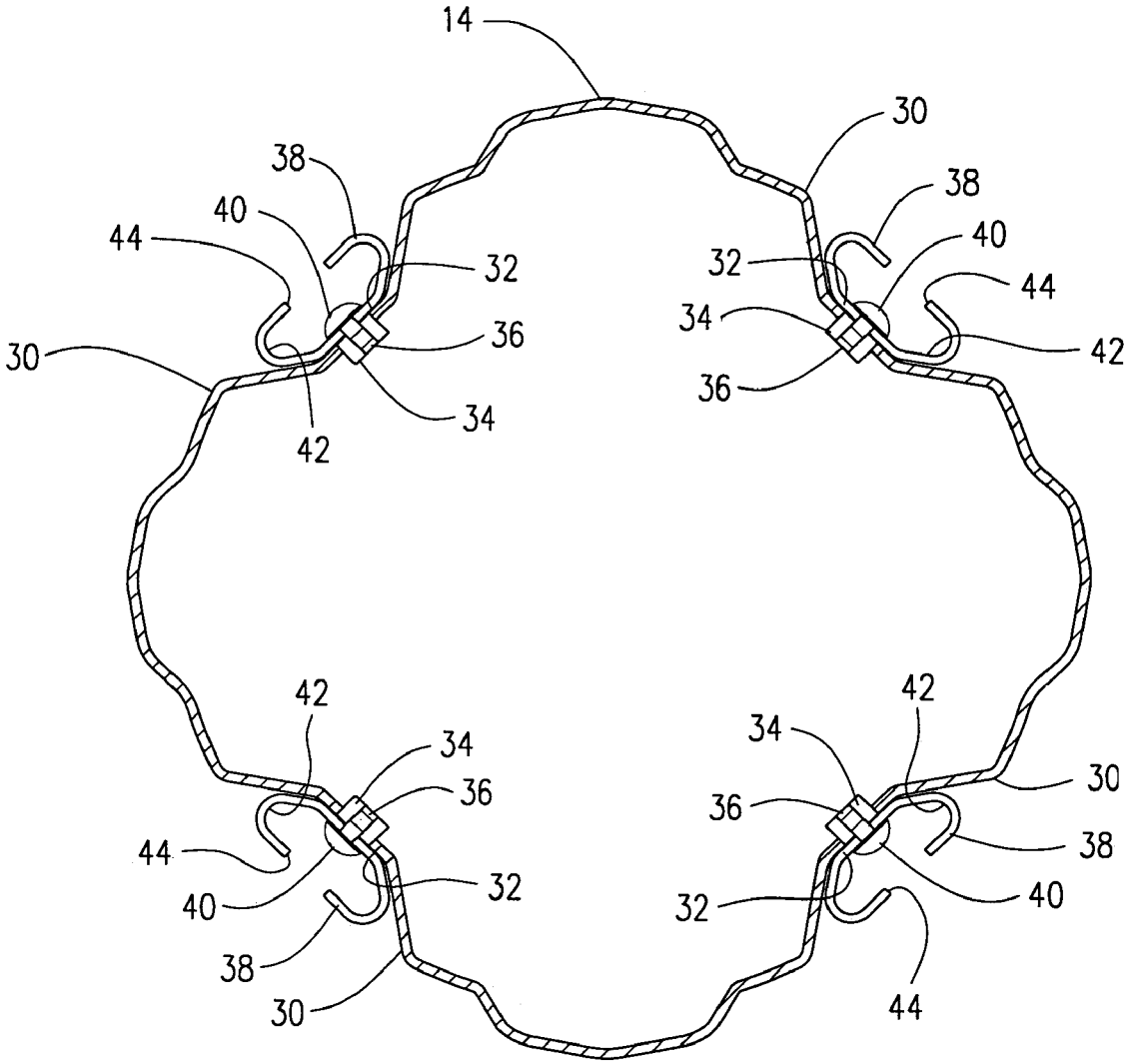
FIG. 3 is a cross-sectional view taken along lines 3—3 in FIG. 1.

Stem 14 has a plurality of sides 30 as best seen in FIG. 3. At the lower end of two opposite sides 30, stem 14 defines indentations 31 as seen in FIGS. 1 and 2. These indentations 31 provide handholds for easily lifting and moving device 10 when base 12 is empty. Each side 30 defines a longitudinally extending groove 32 therein. In the illustrated embodiment, stem 14 is four-sided, but the invention is not intended to be limited to any particular number of sides. A plurality of vertically spaced jacknuts 34 are attached to stem 14 along each of grooves 32. Jacknuts 34 are of a kind known in the art and define a threaded opening 36 therein.

A longitudinally extending rail 38 is positioned in each groove 32 on stem 14. Rails 38 are attached to stem 14 by threaded fasteners 40 which engage corresponding jacknuts 34. Rails 38 have a generally C-shaped cross section such that a longitudinal channel 42 is defined therein. Channel 42 has a longitudinal slot 44 along the outwardly facing side thereof.

Figure 4:
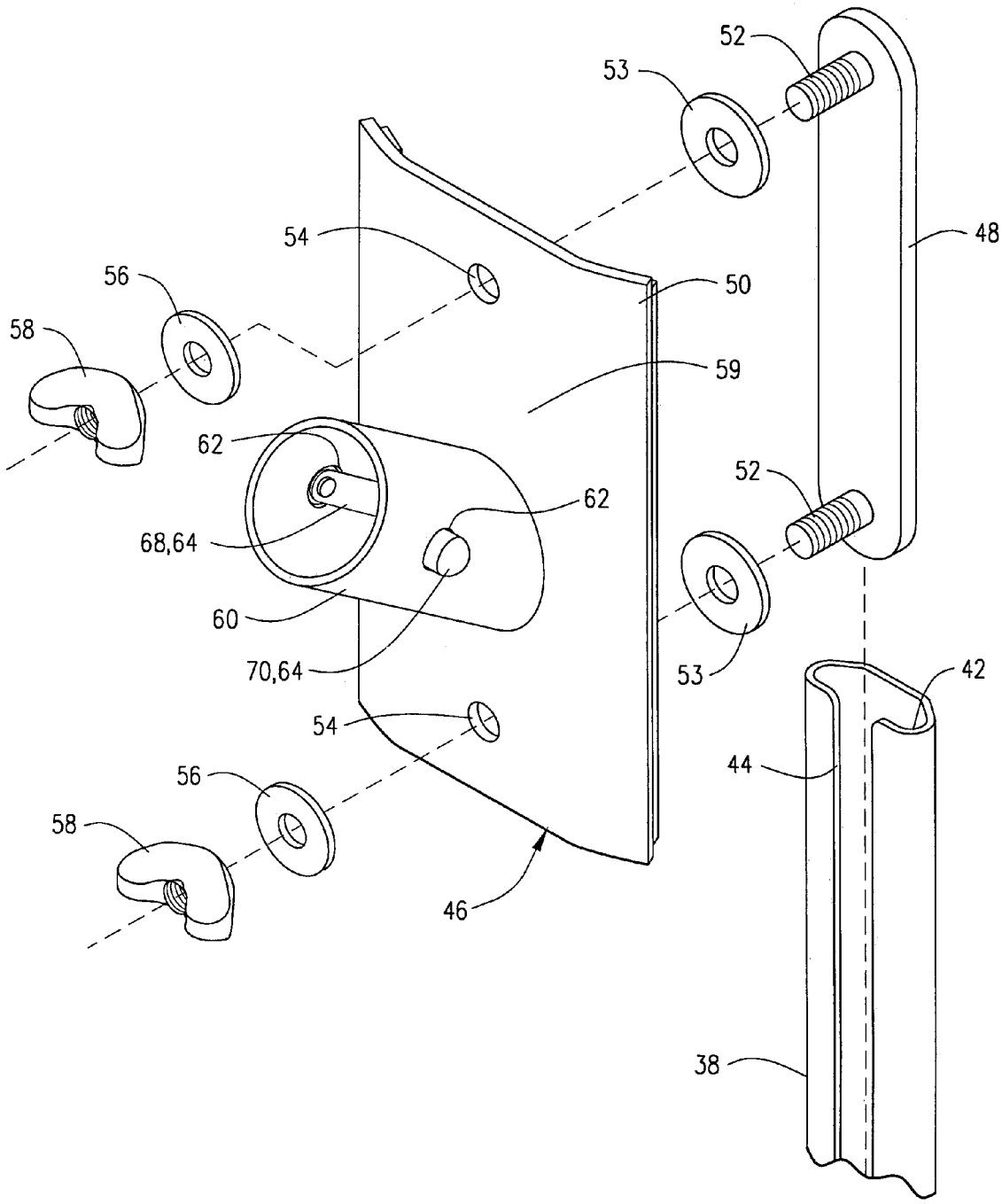
FIG. 4 shows a perspective view of a target adapter assembly.

Each target assembly 16 is attached to one of rails 38 by a target adapter assembly 46. Referring now to FIG. 4, each target adapter assembly 46 comprises a bolt plate 48 and a slider 50.

Bolt plate 48 is slidably disposed in channel 42 of rail 38. Bolt plate 48 is wider than slot 44 and has a pair of threaded rods 52 extending outwardly therefrom through slot 44. Rods 52 have washers 53 thereon which are also positioned in channel 42 of rail 38. Slider 50 is positioned so that threaded rods 52 extend through holes 54 in the slider. A washer 56 is positioned on each threaded rod 52, and a fastener, such as a wing knob or wing nut 58, is engaged with each threaded rod 52. Thus, by tightening wing knobs 58, slider 50 can be clamped against rails 38 on stem 14. By loosening wing knobs 58, slider 50 and bolt plate 48 can be moved together along the length of the corresponding rail 38. It will thus be seen by those skilled in the art that target adapter assemblies 46 are infinitely vertically adjustable along rails 38 and can be locked in any desired position by tightening wing knobs 58. Moving target adapter assemblies 46 from one position to another can thus be done quickly and easily.

Slider 50 has a plate portion 59 and an integral tubular neck 60 extending at an acute angle therefrom. As illustrated in FIG. 4, neck 60 angles upwardly on slider 50, but the slider can be reversed so that the neck angles downwardly. This is illustrated both ways in FIGS. 1 and 2. Each neck 60 has a pair of opposite holes 62 defined therein.

Figure 8:
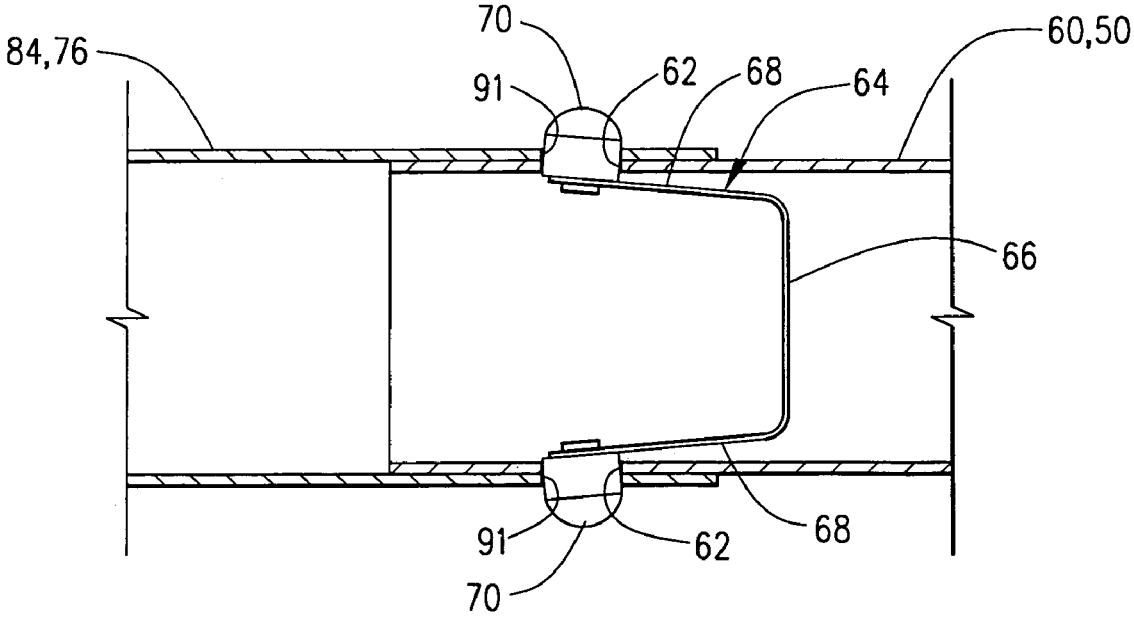
FIG. 8 is a cross section taken along lines 8—8 in FIG. 1.

A spring clip 64 is disposed in each neck 60. Referring also to FIG. 8, spring clip 64 is generally U-shaped and has an intermediate portion 66 and a pair of legs 68 extending from each end of the intermediate portion. Legs 68 are outwardly biased from one another. Each leg 68 has an outwardly extending, rounded lug 70 on the distal end thereof. Spring clip 64 is positioned in neck 60 so that intermediate portion 66 is closest to bolt plate 48 and lugs 70 are aligned with holes 62. The outward bias of legs 68 force lugs 70 outwardly through holes 62. See also FIG. 8. As will be further described herein, a detent mechanism is thus formed.

Figure 5:
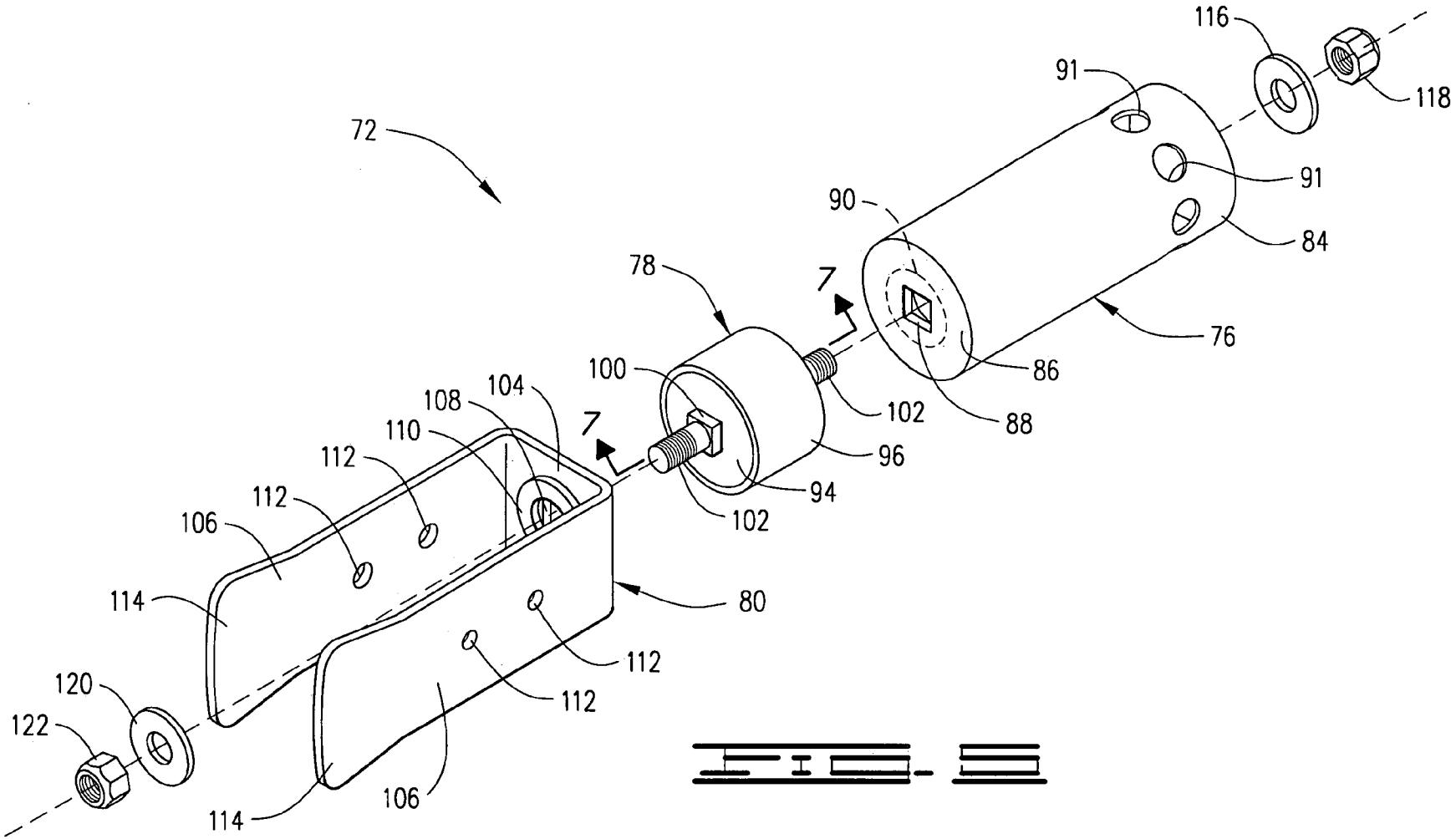
FIG. 5 is an exploded view of a target attachment assembly.
Figure 3:
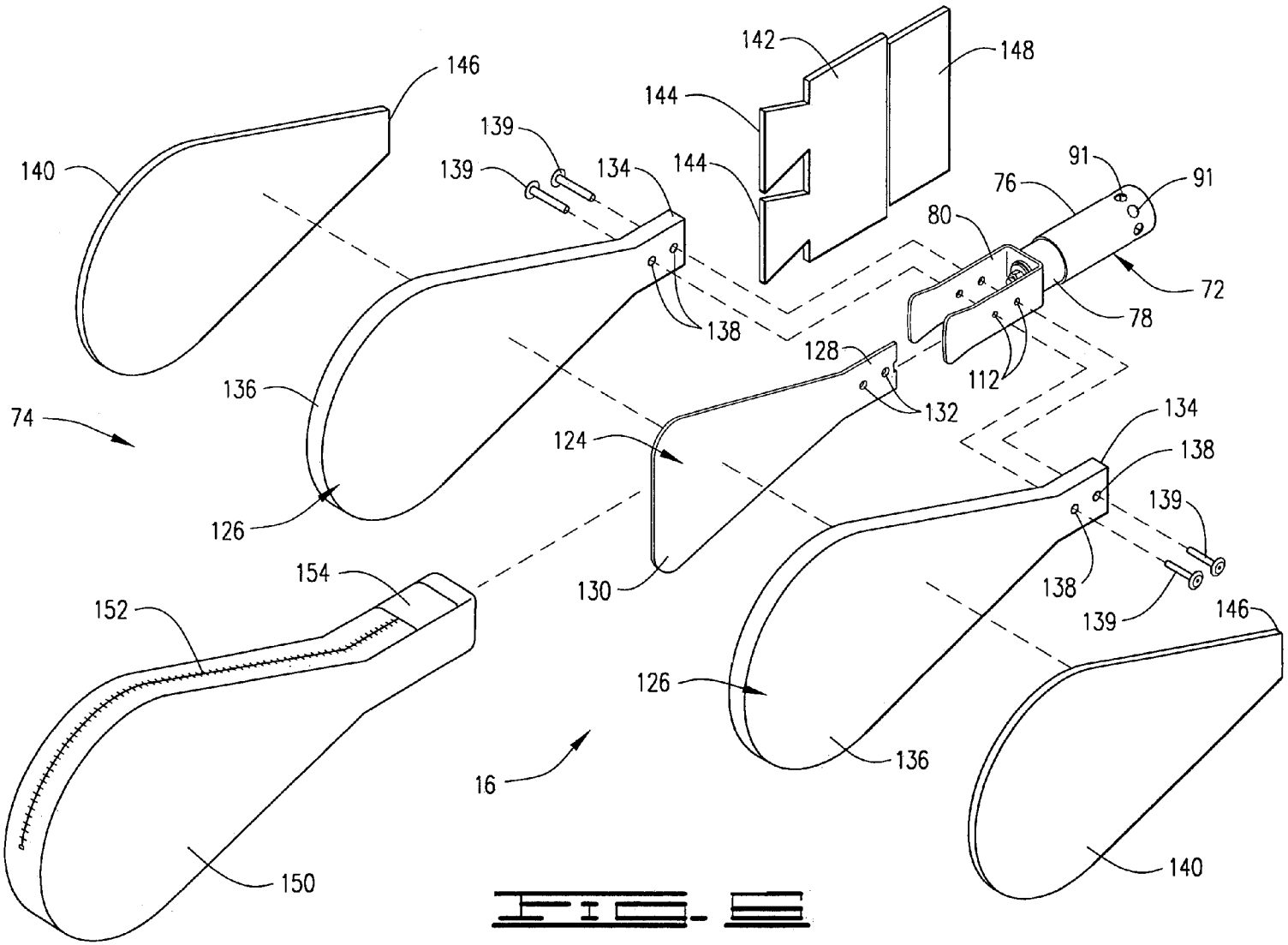

Referring now to FIGS. 5 and 6, each target assembly 16 comprises a target attachment assembly 72 and a target 74. As best seen in FIG. 5, each target attachment assembly 72 comprises a target fitting 76, a pivot assembly 78 and a target bracket 80.

Target fitting 76 is generally cylindrical and has a sleeve portion 84 at one end thereof. The other end of target fitting 76 is closed by an end 86. In the preferred embodiment, sleeve portion 84 and end 86 are integrally formed. End 86 has a square opening 88 therethrough. A washer 90 is permanently attached to the inner side of end 86, such as by welding. Washer 90 is aligned with square opening 88.

Sleeve portion 84 of target fitting 76 has a plurality of angularly spaced holes 91 therein. There are an even number of holes 91 such that there is another hole opposite each hole. That is, there are a series of pairs of holes spaced 180 degrees apart. Holes 91 in target fitting 76 are substantially the same size as holes 62 in neck 60 of slider 50.

Figure 7:
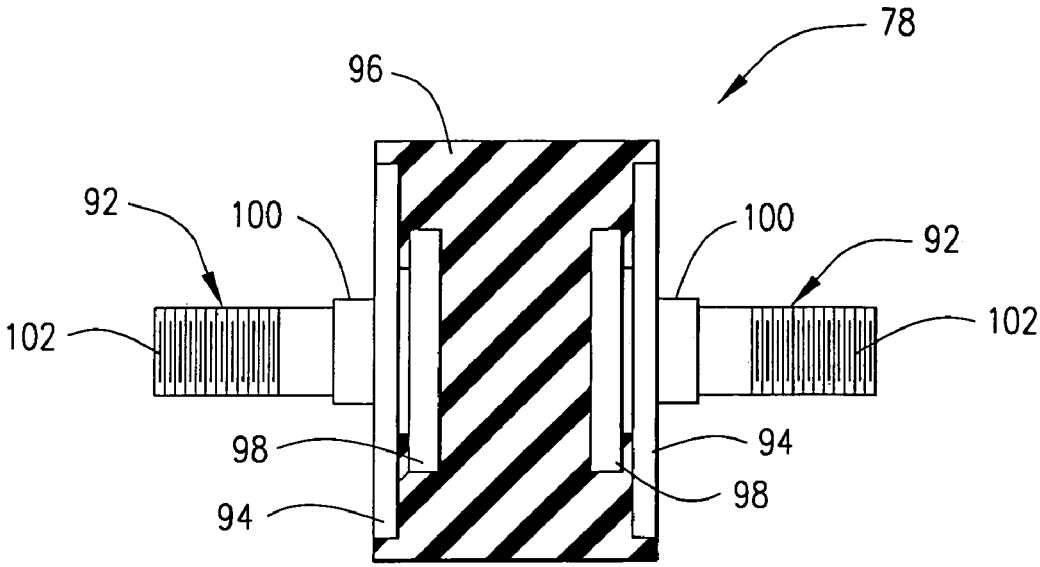
FIG. 7 is a cross section taken along lines 7—7 in FIG. 5.

Referring now also to FIG. 7, pivot assembly 78 comprises a pair of pivot studs 92 and a pair of washers 94 molded into a bushing 96. Bushing 96 is preferably made of an elastomeric material such as rubber. Each pivot stud 92 has a disc 98 with a square stud base 100 thereon. A threaded portion 102 of pivot stud 92 extends from each stud base 100. The elastomeric material of bushing 96 is molded around disc 98 and on one side of washer 94. Thus, pivot assembly 78 is formed as an integral component. Washers 94 provide a metal surface at opposite ends of bushing 96.

Target bracket 80 is formed as a yoke having an end 104 and a pair of fingers 106 extending therefrom. Preferably, end 104 and fingers 106 are integrally formed. End 104 has a square opening 108 therethrough. A washer 110 is permanently attached to end 104 between fingers 106, such as by welding. Washer 110 is aligned with square opening 108. Fingers 106 define opposite pairs of holes 112 therein. Distal ends 114 of fingers 106 are slightly enlarged.

Target attachment assembly 72 is assembled in the following manner. One of pivot studs 92 of pivot assembly 78 is positioned through square opening 88 and washer 90 on target fitting 76. Square stud base 100 of this pivot stud 92 fits closely in square opening 88 so that relative rotation between pivot assembly 78 and target fitting 76 is prevented. Another washer 116 is disposed in target fitting 76 over threaded portion 102 of this pivot stud 92, and a fastener 118, such as a nut, is engaged with threaded portion 102.

The other of pivot studs 92 of pivot assembly 78 is positioned through square opening 108 and washer 110 of target bracket 80. Square stud base 100 of this pivot stud 92 fits closely in square opening 108 so that relative rotation between pivot assembly 78 and target bracket 80 is prevented. Another washer 120 is disposed between fingers 106 of target bracket 80 and over threaded portion 102 of this pivot stud 92, and a fastener 122, such as a nut, is engaged with threaded portion 102.

Referring again to FIG. 6, target 74 comprises a target insert 124 sandwiched between two target foams 126. Target insert 124 is preferably made of a material which is at least somewhat resilient, such as plastic. Target foams 126 are made of a closed cell foam that is resilient and resistant to impact. Target foams 126 are relatively thicker than target insert 124.

Target insert 124 has a proximate end 128 and an enlarged distal end 130. Proximate end 128 has a pair of holes 132 therein which are spaced the same as holes 112 in target bracket 80. Target foams 128 have a proximate end 134 and an enlarged distal end 136. Thus, target foams 128 can be generally described as paddle-shaped. However, other target shapes could also be used, and the invention is not intended to be limited to any particular target shape. Proximate ends 134 of target foams 128 are substantially the same size as proximate end 128 of target insert 124. Distal ends 136 of target foams 126 are somewhat larger than distal end 130 of target insert 124. Each proximate end 134 has a pair of holes 138 therein which are spaced the same as holes 112 in target bracket 80 and holes 132 in target insert 124.

Proximate ends 134 of target foams 128 are aligned with proximate end 128 of target insert 124 and inserted between fingers 106 of target bracket 80 such that corresponding holes 112, 132 and 138 are aligned. A fastener 139, such as a compression rivet, is disposed through each set of aligned holes to attach target 74 to target attachment assembly 72. Thus, target 74, target fitting 76 and pivot assembly 78 are all interconnected to make up target assembly 16.

A foam protective panel 140 is positioned adjacent to each target foam 126. A target attachment foam protective cover 142 is wrapped around target bracket 80 and at least a portion of pivot assembly 78. Ends 144 of foam protective cover 142 are adjacent to ends 146 of foam protective panels 140. A foam protective sleeve 148 is wrapped around a portion of target fitting 76 and pivot assembly 78. Foam protective panel 140, foam protective cover 142 and foam protective sleeve 148 are preferably made of a relatively light flexible foam material and are attached to target 74 and each other by any known means, such as by tape (not shown).

A target cover 150 is disposed on each target 74 and forms a portion of target assembly 16. Target cover 150 is preferably made from a durable cloth or vinyl material and shaped to conform to the shape of target 74. Target cover 150 is held in place by a zipper 152 which is closed when the target cover is in its operating position. A pull (not shown) of zipper 152 may be tucked into a pocket 154 on target cover 150. The only portion of target 74 that is not covered by target cover 150 is the distal end of sleeve portion 84 of target fitting 76 which has holes 91 therein.

Referring again to FIGS. 1, 2 and 8, the complete target assembly 16 may be attached to any of necks 60 on sliders 50 in the following manner. Sleeve portion 84 of target fitting 76 is sized to slide onto neck 60 and fit closely therewith. Any pair of opposite holes 91 are lined up adjacent to lugs 70 on spring clip 64. Lugs 70 are forced inwardly by pushing sleeve portion 84 further onto neck 60. When the desired pair of holes 91 are aligned with holes 62 in neck 60, the biasing action of spring clip 64 will force lugs 70 outwardly so that they extend through holes 62 and 91. As previously mentioned, spring clip 64 and lugs 70 thereon provide a detent mechanism. Thus, target assembly 16 is lockingly attached to target adapter assembly 46 and stem 14. To remove or move any of target assemblies 16, the process is reversed. In the illustrated embodiment, there are eight holes 91 evenly spaced around sleeve portion 84 of target fitting 76. Those skilled in the art will see that this allows attachment of target assemblies 16 in a variety of positions which are spaced 22½ degrees apart, although the invention is not intended to be limited to this particular angular relationship or number of holes 91. It is also a simple matter to adjust the angular position of any target assembly 16 by rotating target fitting 76 on neck 60 until lugs 70 are aligned with another set of desired holes 91.

As previously indicated, sliders 50 can be infinitely variably positioned on rails 38 by use of wing knobs 58 and may be further oriented such that necks 60 of the sliders can angle upwardly or downwardly. This adjustment plus the different angular alignments available resulting from the number of holes 91 give great flexibility in quickly positioning target assemblies 16 with respect to stem 14 and then quickly changing the positioning when desired. FIGS. 1 and 2 show a few of the possible locations and orientations for target assemblies 16.

When target assemblies 16 are attached as desired to stem 14, and after base 12 has been filled with water, the apparatus is ready for use in martial arts practice. Because stem 14 is four-sided, device 10 can be used by up to four people at a time. The person or persons practicing can strike the various target assemblies 16 with hands and/or feet. The resiliency of bushings 96 in pivot assemblies 78 allow for significant angular displacement of target 74 with respect to target adapter assemblies 46 and stem 14, thus absorbing energy from blows to target assemblies 16. This resiliency, of course, also will move target assemblies 16 back to their original positions after being struck. Further, inherent resiliency in target foams 126 also absorbs some of the energy from the practice blows.

It will be seen, therefore, that the martial arts practice device of the present invention is well adapted to carry out the ends and advantages mentioned as well as those inherent therein. Numerous changes in the arrangement and construction of the parts may be made by those skilled in the art. All such changes are encompassed within the scope and spirit of the appended claims.

What is claimed is:

1. A freestanding martial arts practice device comprising:

a hollow base adapted for receiving a weighting fluid therein;

a stem connected to the base and extending upwardly therefrom, said stem defines a plurality of longitudinally extending grooves, each groove adapted for receiving a rail;

a plurality of substantially vertical rails attached within said grooves, each rail defining a channel therein;

a target adapter assembly adapted for connection to a rail, the target adapter assembly providing substantially infinite adjustment along a length of the rail; and a target connected to the target adapter assembly and moveable therewith.

2. The device of claim 1 wherein the stem has a handhold defined thereon.

3. The device of claim 1 wherein the target may be rotated with respect to the target adapter assembly between a plurality of operating positions thereon.

4. The device of claim 3 wherein the target is connected to the target adapter assembly by a detent mechanism.

5. The device of claim 1 further comprising a target attachment assembly interconnecting the target and target adapter assembly.

6. The device of claim 5 wherein the target attachment assembly comprises an elastomeric pivot for providing resilient deflection of the target with respect to the target adapter assembly when the target is struck by a martial arts practitioner.

7. The device of claim 1 wherein the target is disposed at an acute angle with respect to the target adapter assembly.

8. The device of claim 1 wherein the target adapter assembly may be selectively positioned between downwardly and upwardly angled positions of the target.

9. A martial arts practice device comprising:

a base;

a stem extending upwardly from the base;

a rail attached to the stem, the rail defining a channel therein;

a target adapter assembly comprising:

a plate slidably disposed in the channel, the plate having a rod extending therefrom;

a slider disposed adjacent to the rail and having a hole therein adapted for receiving the rod therethrough, said slider has a neck extending therefrom; and a fastener engaging the rod whereby the slider can be locked against the rail at any location therealong; and a target connected by a target attachment assembly to the neck of the target adapter assembly.

10. The device of claim 9 wherein:

the rod is threaded; and the fastener is a wing knob.

11. The device of claim 9 wherein the rail is disposed in a longitudinal groove defined in the stem.

12. The device of claim 9 wherein the target attachment assembly comprises:

a fitting adapted for positioning over the neck;

a bracket adapted for attachment to the target; and a pivot assembly connected between the fitting and bracket such that the target may be pivoted with respect to the target adapter assembly.

13. The device of claim 12 wherein the pivot assembly allows the target to be pivoted in substantially all directions.

14. The device of claim 13 wherein the pivot assembly comprises an elastomeric bushing.

15. The device of claim 12 wherein the pivot assembly further comprises a pair of pivot studs molded into opposite ends of the bushing, one of the pivot studs being adapted for connection to the fitting and the other of the pivot studs being adapted for connection to the bracket.

16. The device of claim 15 wherein relative rotation between the pivot studs, fitting and bracket is prevented.

17. The device of claim 12 wherein the fitting is rotatable with respect to the neck.

18. The device of claim 15 further comprising a detent mechanism for selectively locking the fitting in any one of a plurality of positions with respect to the neck.

19. The device of claim 16 wherein:

the neck defines a hole therein;

the fitting defines a plurality of holes therein selectively alignable with the hole in the neck; and the detent mechanism comprises a spring clip disposed in the neck and having a lug thereon, the lug being outwardly biased such that it will extend through the hole in the neck and any one of the holes in the fitting aligned therewith.

20. The device of claim 12 wherein the target comprises:

a target insert having a proximate end and a distal end;

a target foam adjacent to the target insert and having a proximate end and a distal end;

wherein, the proximate ends of the target insert and target foam are attached to the bracket.

21. The device of claim 20 wherein the target foam is one of a pair of target foams disposed on opposite sides of the target insert.

22. The device of claim 20 wherein:

the bracket has a pair of fingers; and the proximate ends of the target insert and target foam are disposed between the fingers.

23. The device of claim 20 wherein the target further comprises:

a foam protective panel adjacent to the target foam; and a foam protective cover disposed around the pivot assembly.

24. The device of claim 23 further comprising a cover substantially enclosing the target insert, target foam, foam protective panel, foam protective cover and at least a portion of the pivot assembly.

25. The device of claim 9 wherein the neck extends at an acute angle with respect to the rail.

26. The device of claim 25 wherein the slider is selectively positionable between a position in which the neck angles downwardly and a position in which the neck angles upwardly.

27. A martial arts practice device comprising:

a base;

a stem extending upwardly from the base;

a rail attached to the stem wherein the rail is disposed in a longitudinal groove defined in the stem;

a target adapter assembly slidably disposed on the rail;

a target attachment assembly comprising:

a fitting connected to the target adapter assembly;

a bracket; and an elastomeric pivot disposed between the fitting and bracket such that the bracket may be pivoted in substantially any direction with respect to the fitting; and a target attached to the bracket.

28. The device of claim 27 wherein the target attachment assembly further comprises a pair of pivot studs molded into opposite ends of the pivot, one of the pivot studs being adapted for connection to the fitting and the other of the pivot studs being adapted for connection to the bracket.

29. The device of claim 28 wherein:

each of the pivot studs has a square portion;

the fitting has a square opening therein adapted for receiving the square portion of one of the pivot studs such that relative rotation between the pivot and fitting is prevented; and the bracket has a square opening therein adapted for receiving the square portion of the other of the pivot studs such that relative rotation between the pivot and bracket is prevented.

30. The device of claim 27 wherein the fitting is rotatable with respect to the target adapter assembly.

31. The device of claim 30 further comprising a detent mechanism for selectively locking the fitting in any of a plurality of positions with respect to the target adapter fitting.

32. The device of claim 27 wherein the target adapter assembly comprises:

a slider disposed adjacent to the rail and having a hole therein;

a plate slidably disposed on the rail and having a rod extending through the hole in the slider; and a fastener engaged with the rod whereby the target adapter assembly can be locked at any location along the rail;

wherein, the fitting is attached to the slider.

33. The device of claim 32 wherein:

the slider has a neck extending therefrom; and the fitting is adapted for positioning over the neck.

34. The device of claim 33 wherein the fitting is rotatable with respect to the neck.

35. The device of claim 34 further comprising a detent mechanism disposed in the neck for locking the fitting with respect to the neck.

36. The device of claim 35 wherein:

the neck defines a hole therein;

the fitting defines a plurality of holes therein selectively alignable with the hole in the neck; and the detent mechanism comprises a spring clip disposed in the neck and having a lug thereon, the lug being outwardly biased such that it will extend through the hole in the neck and any one of the holes in the fitting aligned therewith.

37. The device of claim 33 wherein the neck extends at an acute angle with respect to the rail.

38. The device of claim 37 wherein the slider is selectively positionable between a position in which the neck angles downwardly and a position in which the neck angles upwardly.

39. The device of claim 27 wherein the target comprises:

a target insert having a proximate end and a distal end;

a target foam adjacent to the target insert and having a proximate end and a distal end;

wherein, the proximate ends of the target insert and target foam are attached to the bracket.

40. The device of claim 39 wherein the target foam is one of a pair of target foams disposed on opposite sides of the target insert.

41. The device of claim 39 wherein:

the bracket has a pair of fingers; and the proximate ends of the target insert and target foam are disposed between the fingers.

42. The device of claim 39 wherein the target further comprises:

a foam protective panel adjacent to the target foam; and a foam protective cover disposed around the pivot assembly.

43. The device of claim 42 further comprising a cover substantially enclosing the target insert, target foam, foam protective panel, foam protective cover and at least a portion of the pivot assembly.

44. The device of claim 27 wherein the target is one of a plurality of interchangeable targets.

* * * * *